United States Patent [19]

Winchell et al.

[11] 3,954,356

[45] May 4, 1976

[54] ROTARY ENGINE ROTOR HOUSING HAVING COOLANT COOLED BRIDGED EXHAUST PORT

[75] Inventors: Frank J. Winchell, Orchard Lake; Clarence C. Irwin, Sterling Heights; Jerry R. Mrlik; Roy S. Cataldo, both of Birmingham, all of Mich.

[73] Assignee: General Motors Corporation, Detroit, Mich.

[22] Filed: Nov. 1, 1974

[21] Appl. No.: 519,813

[52] U.S. Cl. ..... 418/83; 418/113; 123/8.01

[51] Int. Cl.[2] ..... F01C 21/06; F01C 19/02; F02B 53/00

[58] Field of Search ..... 418/83, 61 A, 113; 123/8.01, 8.45

[56] References Cited

UNITED STATES PATENTS

| | | | |
|---|---|---|---|
| 3,007,460 | 11/1961 | Bentele et al. | 418/83 |
| 3,193,186 | 7/1965 | Peras | 418/252 |
| 3,286,701 | 11/1966 | Kling et al. | 123/8.07 |
| 3,448,727 | 6/1969 | Kobayakawa | 418/61 A |
| 3,483,850 | 12/1969 | Yamamoto et al. | 418/61 A |

FOREIGN PATENTS OR APPLICATIONS

| | | | |
|---|---|---|---|
| 993,461 | 5/1965 | United Kingdom | 418/61 A |

*Primary Examiner*—John J. Vrablik
*Attorney, Agent, or Firm*—Ronald L. Phillips

[57] ABSTRACT

A rotary engine rotor housing having an exhaust port in the rotor housing's inner peripheral wall which is spanned at the center by a peripherally extending bridge that is coextensive with the inner peripheral wall and has a coolant passage therethrough through which coolant is forced to circulate from one axial flow coolant passage in the rotor housing to another by means of heating, velocity differential, ram effect and a negative pressure zone.

15 Claims, 19 Drawing Figures

ROTARY ENGINE ROTOR HOUSING HAVING COOLANT COOLED BRIDGED EXHAUST PORT

This invention relates to a rotary engine rotor housing having a coolant cooled bridged exhaust port and more particularly to such a bridge wherein coolant is forced to circulate therethrough.

In rotary combustion engines having an exhaust port in the inner peripheral wall of the rotor housing, it has been found that the apex seals on the rotor flex as a free ended beam as they pass over the exhaust port and that this flexing can cause damage of these seals. Heretofore the practice has been to increase the apex seals' beam strength by suitable choice of materials and/or apex seal design to prevent excessive flexing as they pass over the exhaust port. However, long wear life is also required for the apex seals and as a result compromises have been made to balance between long wear life and seal rigidity.

According to the present invention, freedom of choice of materials and design for the apex seal is made possible by eliminating the rigidity requirements imposed by a conventional peripheral exhaust port by the provision of a coolant cooled bridge. The bridge is coextensive with the inner peripheral wall and spans the exhaust port to provide intermediate support thereacross for the apex seals as they slide the length of the exhaust port. Cooling of the bridge is provided by coolant passage means which in various embodiments forms a coolant passage of varying elevation through the bridge that is open at its opposite ends to existing coolant passages in the rotor housing and through which coolant is effectively caused to flow.

An object of the present invention is to provide a coolant cooled bridged exhaust port in a rotor housing of a rotary combustion engine.

Another object is to provide in a rotary combustion engine rotor housing having an exhaust port in the inner peripheral wall thereof a bridge that extends across the exhaust port to provide intermediate support for the engine's apex seals as they slide on the inner peripheral wall across the exhaust port and wherein coolant is effectively caused to flow through the bridge.

Another object is to provide a rotary combustion engine rotor housing an exhaust port in the inner peripheral wall which is spanned by a bridge that provides intermediate support for the apex seals as they slide on the peripheral wall past the exhaust port and wherein the bridge is cooled by a coolant passage therethrough of varying elevation that opens at its opposite ends to adjacent coolant passages in the rotor housing so as to effect forced coolant flow therethrough by heating of the coolant while in this passage and by other ways including velocity differential.

These and other objects of the present invention will be more apparent from the following drawing and description in which.

Figure 1:
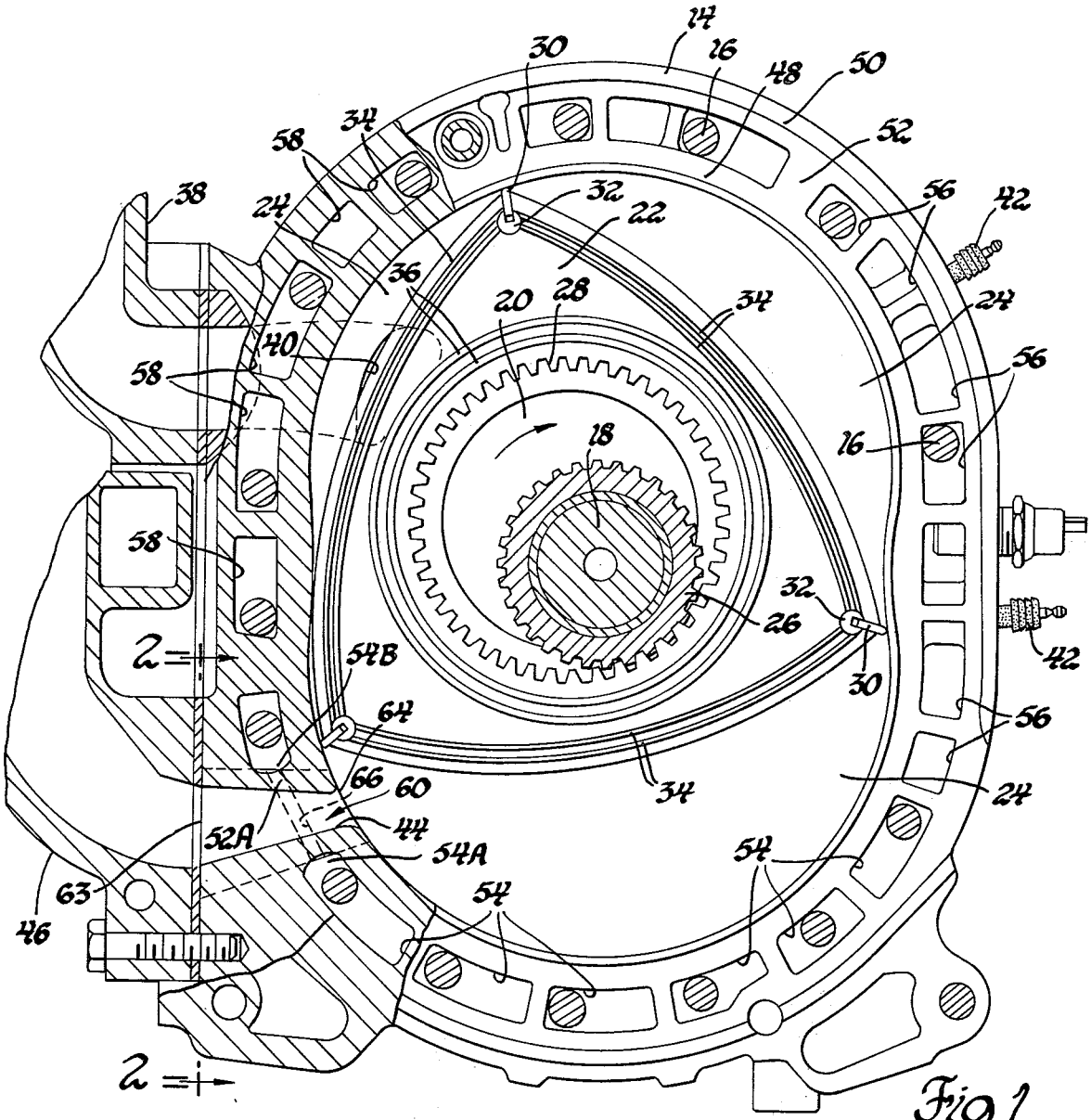
FIG. 1 is an end elevational view with parts in section of a rotary combustion engine having a coolant cooled bridged exhaust port according to one embodiment of the present invention.

The invention is shown in use in a rotary combustion engine like that disclosed in copending United States application Ser. No. 472,429, filed May 22, 1974 now Pat. No. 3,907,468 and assigned to the assignee of this invention, with those related parts of the engine which are helpful to understanding the present invention shown in FIGS. 1 and 19. The engine includes a front end housing 10, an intermediate housing 12, a rear end housing (not shown) and a pair of identical rotor housings 14 (only one of which is shown) each of which is located between one of the end housings and the intermediate housing. These housings are all clamped together by bolts 16. A crankshaft 18 extends through the intermediate housing 12 and the two rotor housings 14 and is rotatably supported near its opposite ends in the end housings with its crankshaft axis coincident with the center of the rotor housings. The crankshaft 18 is provided in each rotor housing with an eccentric 20 on which a rotor 22 is mounted for rotation about the eccentric's center, the two rotor centers being located 180° apart and spaced equal distances from the crankshaft axis. The rotors 22 have the general shape of a triangle and cooperate with the two-lobe inner periphery of the rotor housings 14 to define three variable volume working chambers 24 that are spaced about and move with the rotors within the engine housing while varying in volume.

A fixed cyclic relation between each of the rotors and the crankshaft and also relative to the engine housing is obtained by gearing. For example, as shown in FIG. 1, there is provided a stationary external tooth gear 26 which is fixed to the front end housing 10 and is received about and is concentric with the crankshaft 18. The gear 26 meshes with an internal tooth gear 28 that is concentric with and formed on or connected as a separate part to the outboard side of the front rotor 22. The rotary gear 28 has one and one-half times the number of teeth as the stationary gear 26 with the result that they enforce a fixed cyclic relation such that the crankshaft makes three complete revolutions for every one complete revolution of the rotor. Similarly, the other rotor has a concentric gear thereon which meshes with an external gear received about the other outboard end of the crankshaft with their mesh diametrically opposite that of the gear shown. Thus, the chambers 24 move with the respective rotors while they revolve about their axes while also revolving about the crankshaft axis with each chamber twice undergoing expansion and contraction during each rotor revolution in fixed relation to the engine housing.

Sealing of the working chambers is effected by seals carried on each rotor comprising three apex seals 30, each of which extends the width of the rotor and is mounted in an axially extending slot at one of the rotor apexes, six corner seals 32 each of which is mounted in a hole in one of the rotor sides near one of the rotor apexes, and twelve side seals 34 each of which is mounted in an arcuate groove in one of the rotor sides with the latter seals arranged in pairs and extending adjacent one of the rotor faces between two of the corner seals and with the corner seals each providing a sealing link between one apex seal and the adjacent ends of two pairs of side seals. The apex seals are each spring biased radially outward to continuously engage the rotor housing and both the corner seals and the side seals in both rotor sides are spring biased axially outward to continuously engage the respective end and intermediate housings. In addition, there is mounted in grooves in each rotor side inward of the side seals 34 a pair of spring biased circular oil seals 36 which are concentric with the rotor and sealingly engage the opposing wall of the respective housings to prevent oil from reaching further outward.

A combustible air-fuel mixture is delivered by a carburetor (not shown) to an intake manifold 38 which is connected to the engine housing and has branches that communicate with intake ports 40 in the end and intermediate housings. Upon rotor rotation in the direction of the arrow in FIG. 1, the mixture is admitted to the chambers 24 as they are expanding by the traversing motion of the rotor sides relative to the intake ports 40 whereafter the chambers then close to the intake ports and contract the thus trapped mixture in readiness for ignition. Combustion by spark ignition is provided by an ignition system (not shown) which applies voltage at the proper time to pairs of spark plugs 42 which are mounted on the rotor housings 14 and have their electrodes open to the working chambers as they pass. Both plugs are fired at the same time or different times or only one plug is fired according to certain engine operating conditions as is well known. With combustion, the rotor housing takes the reaction to force the rotor to continue rotating and eventually each working chamber following the power phase is exhausted during the exhaust phase by an exhaust port 44 which extends through the rotor housing and is open to an exhaust manifold 46, the exhaust port 44 being elongated in the axial direction at its inner end and being traversed by the rotor apexes to separately open the chambers to exhaust.

Figure 19:
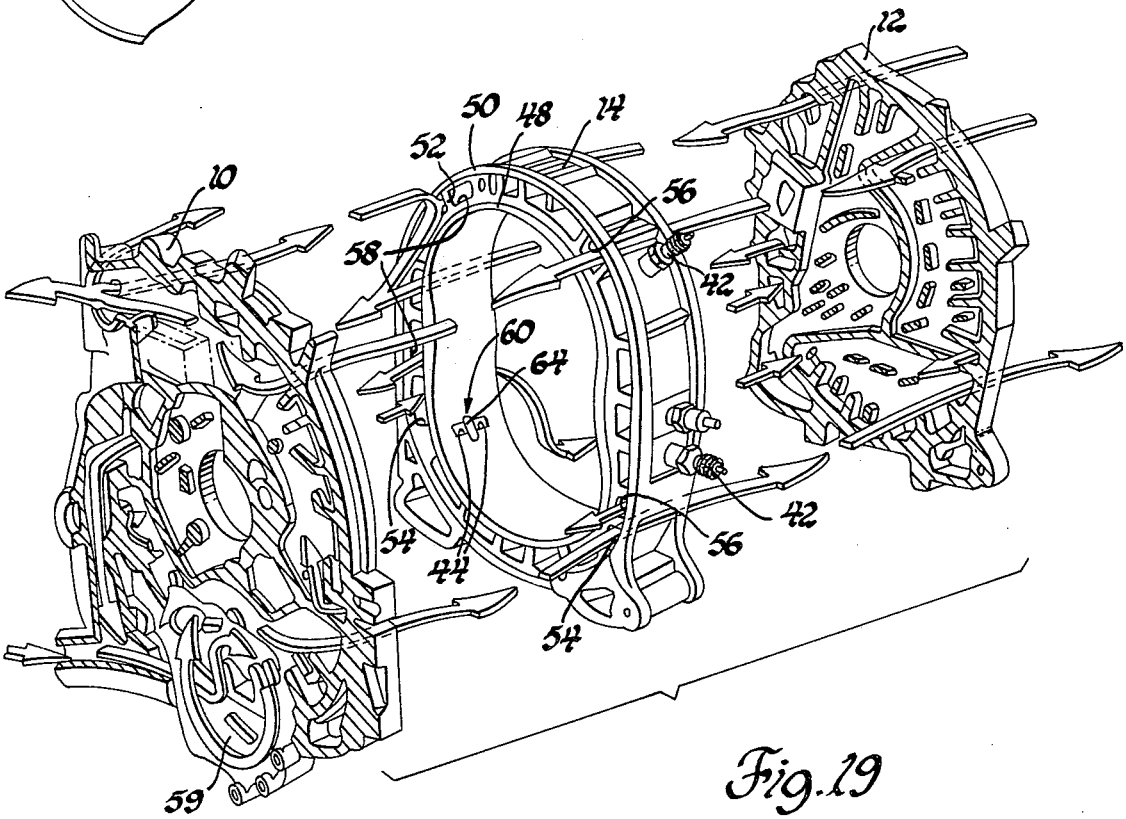
FIG. 19 is an exploded view with the FIG. 1–3 embodiment of parts of the engine illustrating its coolant flow circuit.

Coolant circulation to cool the engine is provided by passageways formed in the housings which effect an axial flow pattern as shown in FIG. 19. In providing this circulation the rotor housings 14 have radially spaced inner and outer peripheral walls 48 and 50 which are joined by a plurality of generally radially extending ribs 52 and cooperatively define groups of series connected axially extending coolant passages 54, 56 and 58. Furthermore, it is through the rib designated 52A that the exhaust port 44 extends, this rib thus being tubular and having a larger cross-sectional outline than the others to provide therefor. In the circulation provided, coolant from a pump cavity 59 in the front end housing 10 is delivered to the passages 54 which extend over an intermediate heat range of the engine and direct the flow toward the rear. At the rear end housing this coolant is then all directed to the passages 56 which extend about the hotest region of the engine and channel the flow back toward the front. At the front end housing 10, this coolant is then directed by the operation of a thermostatically controlled valve (not shown) through either the passages 58 which are located in the coolest or least hotest region of the engine or the coolant after leaving the hotest region is externally cooled in a radiator and then directed through the coolest region before being recirculated through the pump.

The engine structure thus far described, except for the bridged exhaust port, is of known type and for further details thereof reference may be made to the aforementioned United States patent application. In such engine arrangements wherein the exhaust port does not have a bridge and noting that it does extend a substantial portion of the width of the rotor housing, it has been found that the apex seals flex outward at their center as they pass over the exhaust port and this can cause them to have a short life. To prevent such flexing and thus enhance the life of the apex seals and/or permit a wider range of materials and designs for the apex seals, the inner peripheral wall 48 of the rotor housings is provided with a peripherally extending coextensive bridge that spans the center of the exhaust port to provide a center support for the apex seals as they slide past to prevent the flexing that had been occurring. In addition, bridge coolant passage means are provided which effect a coolant passage through this bridge that is open at its opposite ends to the axially extending coolant passages on the opposite sides of the rib containing the exhaust port so as to effect forced coolant flow through the bridge to thereby prevent the bridge from overheating.

Figure 2:
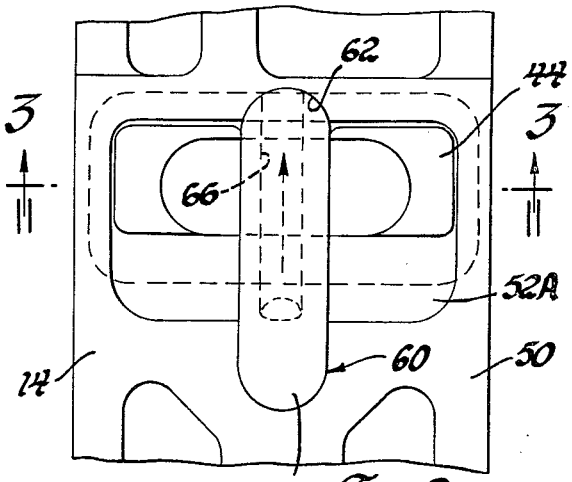
FIG. 2 is an enlarged view taken along the line 2—2 in FIG. 1.
Figure 3:
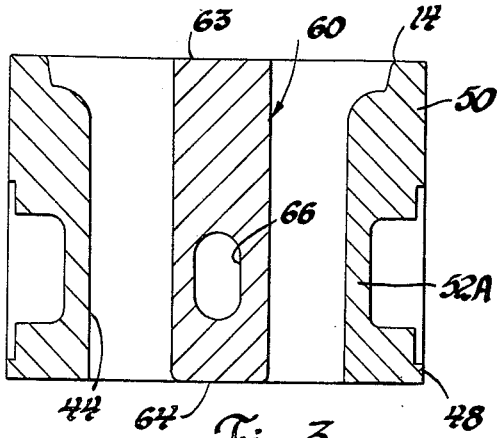
FIG. 3 is a view taken along the line 3—3 in FIG. 2.

One embodiment of the coolant cooled bridged exhaust port is shown in FIGS. 1 through 3 and 19 and comprises a rectangularly shaped insert 60 with a tapering cross-section and rounded corners that tightly fits in and is properly located by a corresponding slot 62 that is machined in the rotor housing's exhaust port rib 52 on opposite sides of the exhaust port 44 and through the peripheral walls 50 and 48. The insert 60 is retained by having a flat outer end 63 coextensive with the rotor housing's interface opposite the bolted exhaust manifold's interface. The insert's inner end 64 is formed to provide a bridge that is coextensive with the inner surface of the rotor housing's inner peripheral wall 14 and spans the center of the exhaust port 44 in the peripheral direction at right angles to the apex seals as best shown in FIGS. 1, 3 and 19. As best shown in FIGS. 1 and 2, the slot 62 in the rotor housing breaks out into the rotor housing's axial coolant passages designated 54A and 54B which extend at different elevations on the respective lower and upper sides of the exhaust port rib 52A. The insert 60 is provided with a passage 66 extending therethrough that with the insert in place thus forms a coolant path of varying elevation through the length of the bridge 64 that is open at its opposite ends to the coolant flowing in the engine's coolant system. Because hot exhaust gas is all about the bridge 64, the coolant while in the bridge's coolant passage 66 is heated very rapidly and rises to thus effect continuous circulation therethrough in the upward direction as shown by the arrow in FIG. 2. In addition, the flow areas and/or restrictions in the axial coolant passages 54A and 54B are made substantially different so that the velocity in the lower rotor housing coolant passage 54A past the lower end of the bridge coolant passage 66 is substantially less than the velocity in the upper rotor housing coolant passage 54B past the upper end of the bridge coolant passage. As a result of the substantial velocity differential thus provided, there is produced a flow potential according to Bernoulli which forces flow through the bridge coolant passage in the direction of higher velocity and thus in the desired upward direction to assist in the circulation effected by heating as previously described.

Figure 4:
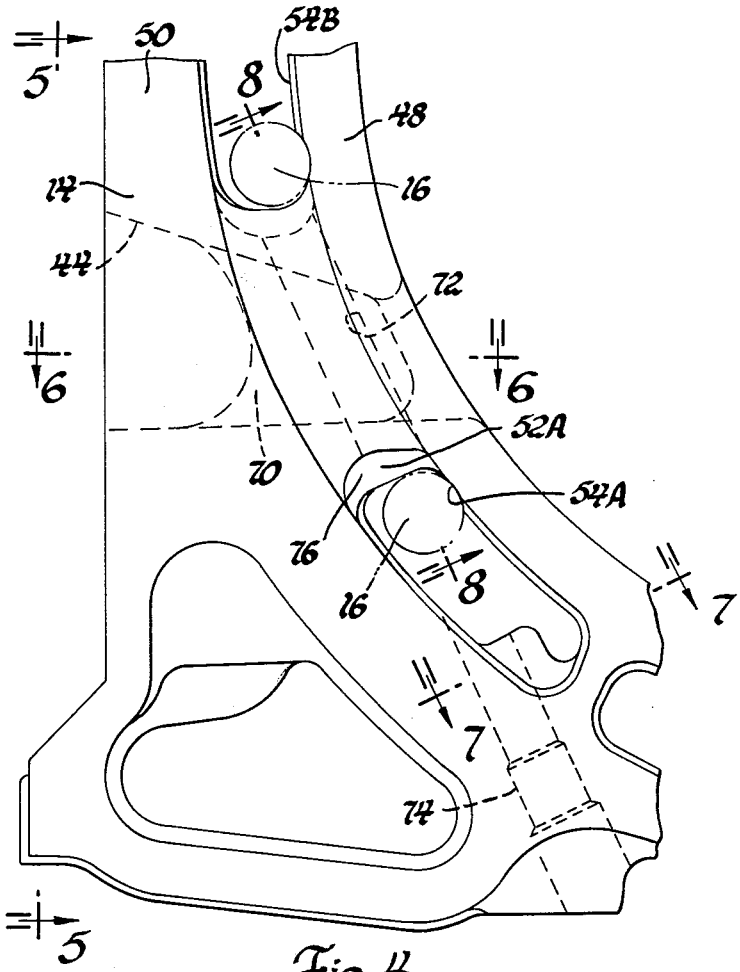
FIG. 4 is an enlarged partial end elevational view showing another embodiment of the coolant cooled bridged exhaust port according to the present invention.
Figure 6:
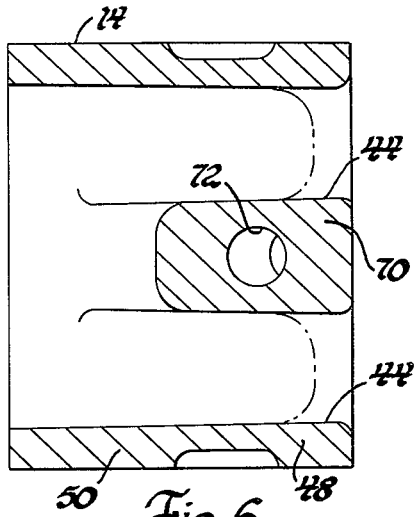
FIG. 6 is a view taken along the line 6—6 in FIG. 4.
Figure 7:
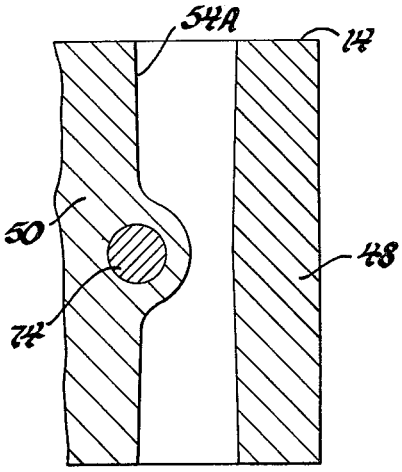
FIG. 7 is a view taken along the line 7—7 in FIG. 4.
Figure 5:
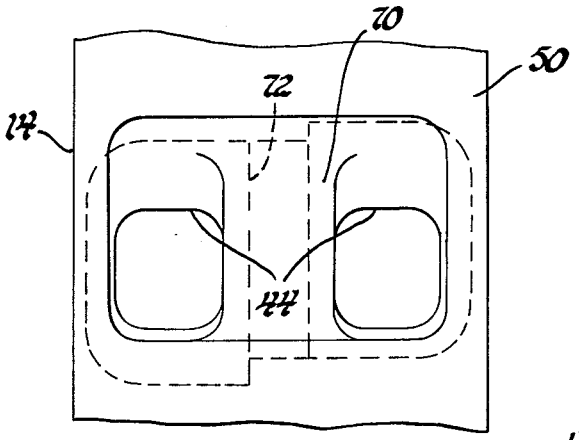
FIG. 5 is a view taken along the line 5—5 in FIG. 4.
Figure 8:
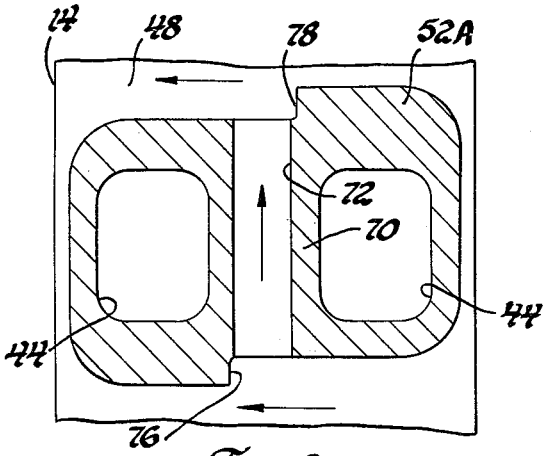
FIG. 8 is a view taken along the line 8—8 in FIG. 4.
Figure 9:
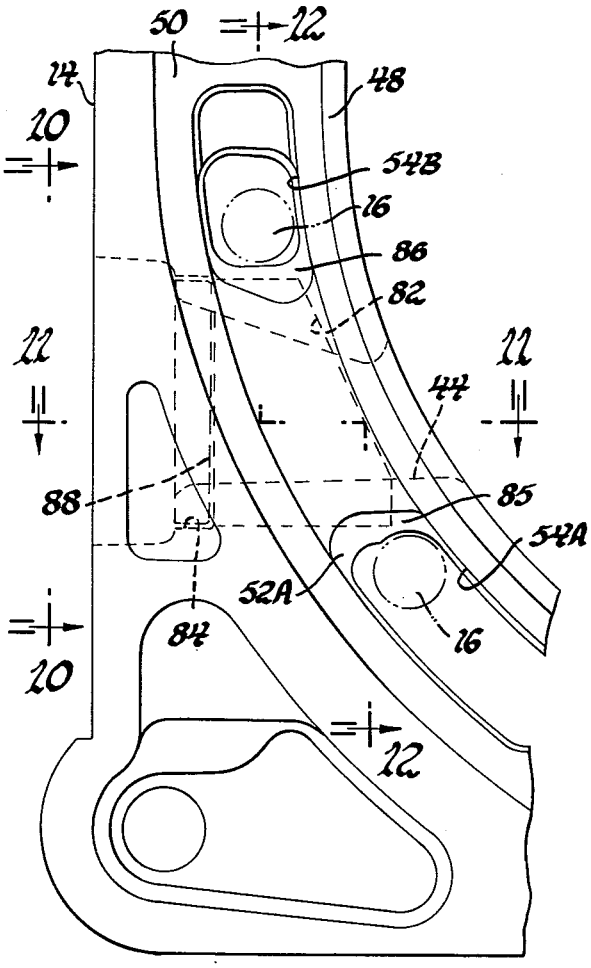
FIG. 9 is a view similar to FIG. 4 showing another embodiment of the coolant cooled bridged exhaust port according to the present invention.
Figure 11:
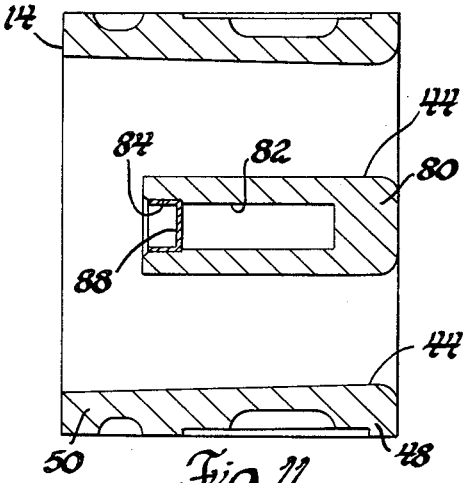
FIG. 11 is a view taken along the line 11—11 in FIG. 9.

In another embodiment of the present invention shown in FIGS. 4 through 8, it is demonstrated that a bridge 70 can be cast in place rather than fabricated and with special provisions to ram and otherwise cause flow through the bridge rather than relying on the circulation provided by heating and the Bernoulli effect. The cast bridge 70 spans the center of the exhaust port 44 as before and has a peripherally extending coolant passage 72 bored therethrough which is open at its opposite ends at the exhaust port rib 52A to the lower and upper rotor housing coolant passages 54A and 54B. The bridge coolant passage 72 is bored up from the bottom of the rotor housing through the outer peripheral wall 50 which is then closed by a plug 74 that is press-fitted therein to prevent coolant from escaping from the lower coolant passage 54A as best shown in FIGS. 4, 6 and 7. With this arrangement, flow upward through the bridge's collant passage 72 is forced by heating and the velocity differential as before. But as best shown in FIGS. 5 and 8, the exterior of the rib 52A is now provided with a cast cross-section that forms a projection 76 at the lower end of the bridge coolant passage 72 on the downstream side thereof that projects out into the axially flowing coolant in the lower rotor housing coolant passage 54A. As a result, coolant impinges upon projection 76 and is directed into the bridge coolant passage 72 to thus induce upward flow with a ram effect. In addition, the rib exterior is provided with a projection 78 on the opposite side that projects into the axially flowing coolant in the upper rotor housing coolant passage 54B from the upstream side of the upper end of the bridge coolant passage 72 so as to create a negative pressure zone to help induce the upward flow.

Figure 12:
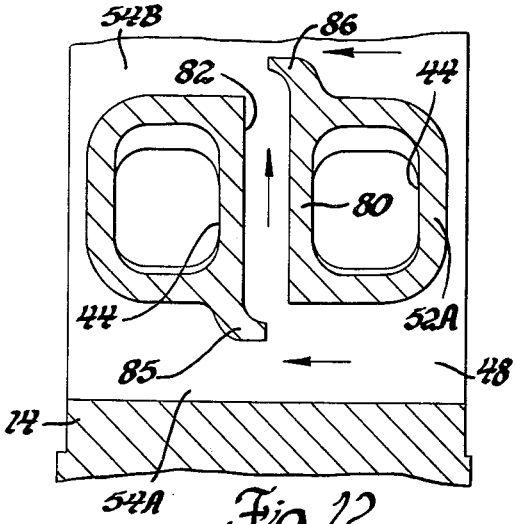
FIG. 12 is a view taken along the line 12—12 in FIG. 9.
Figure 10:
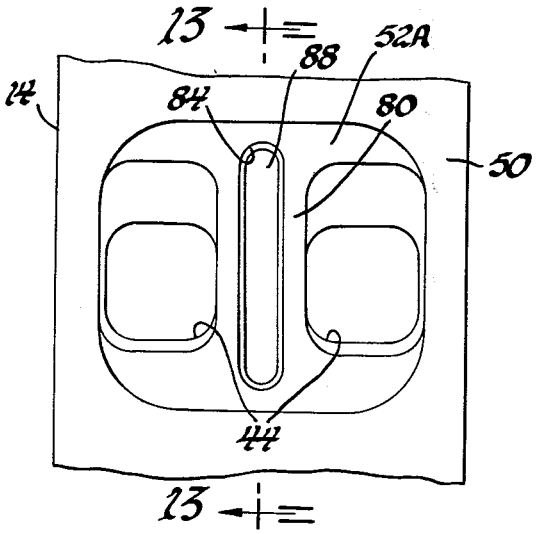
FIG. 10 is a view taken along the line 10—10 in FIG. 9.
Figure 13:
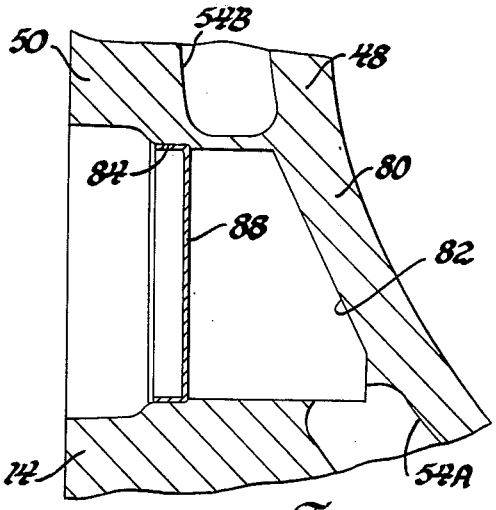
FIG. 13 is a view taken along the line 13—13 in FIG. 10.

Instead of casting the bridge and drilling the coolant passage therethrough, both the bridge and the coolant passage may be simply cast using a core opening that is then simply closed to prevent coolant from escaping as shown in the embodiment of the present invention in FIGS. 9 through 13. In this case, there is provided a bridge 80 that is cast integral with the rotor housing to join with both the inner and outer peripheral walls 48 and 50 and with this bridge having a coolant passage 82 cored therein that extends therethrough and opens or breaks out at its opposite ends to the lower and upper rotor housing coolant passages 54A and 54B as best shown in FIG. 12. Again the exterior of rib 52A is formed to have projections 85 and 86 that project into the axially flowing coolant at the opposite ends of the bridge coolant passage 82 to effect forced coolant flow therethrough in the upward direction like in the embodiment in FIGS. 4 through 8. In coring the bridge coolant passage 82 there is left a core opening 84 in its radially outward side in the outer peripheral wall 50. The core opening 84 which has a rectangular shape with rounded corners is provided with an internal shoulder therearound into which is press-fitted a sheet metal cup 88 that thus effects very simple closure along the bridge's open side at the outer peripheral wall 50.

Figure 14:
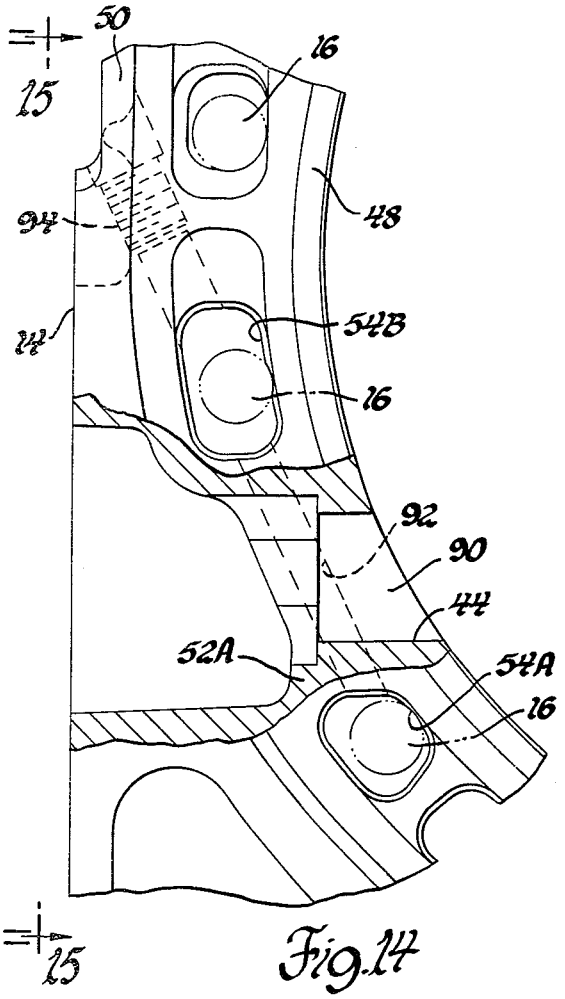
FIG. 14 is a view similar to FIG. 4 showing another embodiment of the coolant cooled bridged exhaust port according to the present invention.
Figure 15:
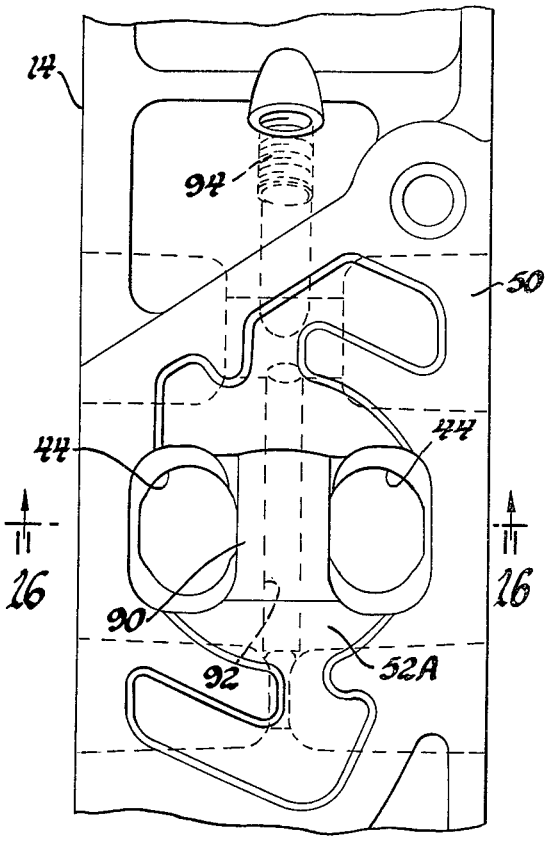
FIG. 15 is a view taken along the line 15—15 in FIG. 14.
Figure 16:
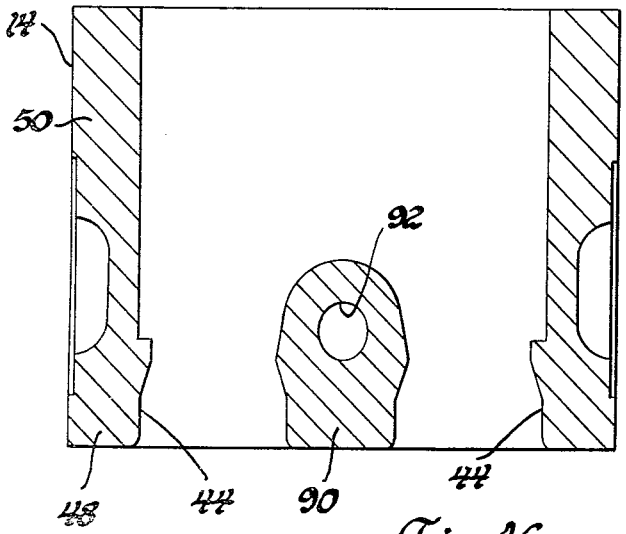
FIG. 16 is an enlarged view taken along the line 16—16 in FIG. 15.

In another embodiment of the present invention as shown in FIGS. 14 through 16, it is shown that a bridge 90 can be cast in place to span the center of the exhaust port 44 in the peripheral direction and a coolant passage 92 then formed therethrough by drilling at an oblique angle through the outer wall 50 from above the exhaust port as best shown in FIG. 14, the hole thus left in the outer wall 50 then being simply closed by a threaded plug 94. The coolant passage 92 that is thus formed is open at its opposite end to the lower and upper rotor housing coolant passages 54A and 54B and coolant flow therethrough thus occurs like in the embodiment in FIGS. 1 through 3.

Figure 17:
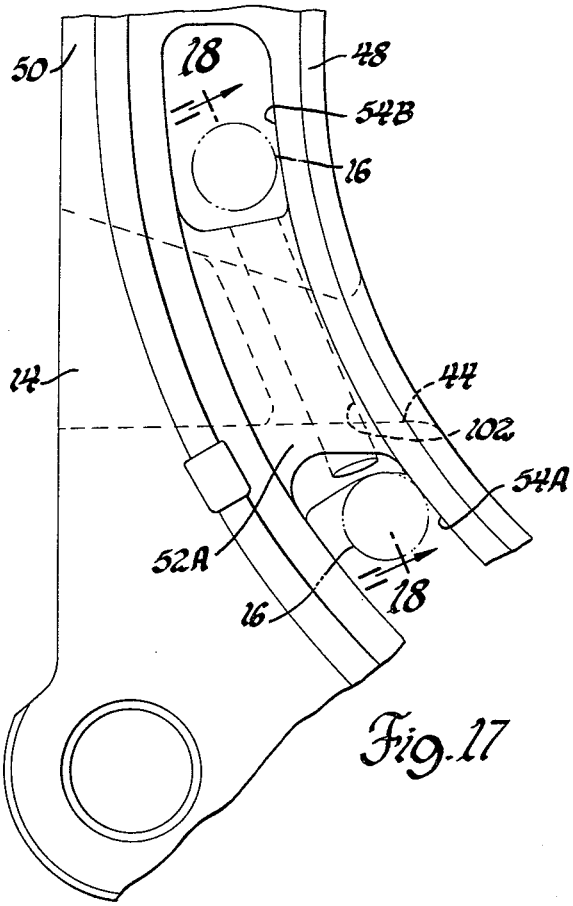
FIG. 17 is a view similar to FIG. 4 showing another embodiment of the coolant cooled bridged exhaust port according to the present invention.
Figure 18:
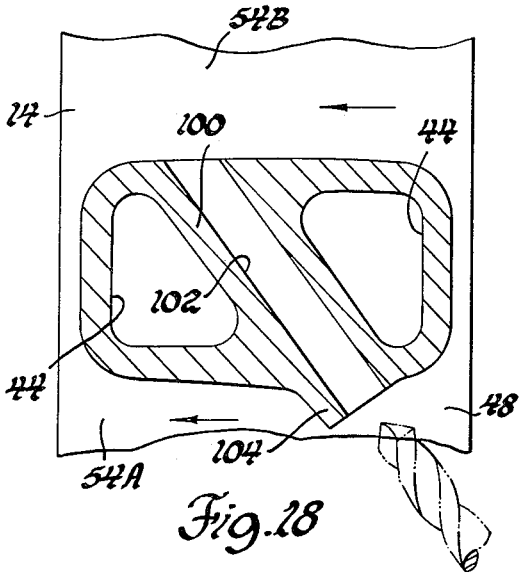
FIG. 18 is a view taken along the line 18—18 in FIG. 17.

As shown in another embodiment of the present invention in FIGS. 17 and 18, a bridge 100 can be cast in place in a generally peripheral direction but diagonal of the rectangularly shaped exhaust port 44 and thus at an acute angle to the apex seals rather than directly along the peripheral center line thereof as in the previous embodiments where the bridges are at right angles to the apex seals. This permits a coolant passage 102 to be bored from one side of the rotor housing as can be seen in FIG. 18. In this case, the cast bridge 100 is provided with a single projection 104 that projects at the lower end of bridge coolant passage 102 at its downstream side into the coolant flow in the lower passage 54A so that coolant impinges thereon and is directed upwardly into the bridge coolant passage. The break-out of the upper end of coolant passage 102 through the horizontal wall at the other side of the rib 52A is at an angle to the flow in the upper passage 54B and provides a negative pressure zone which cooperates with the projection at the other end to help effect forced coolant flow therethrough.

Thus, in all the embodiments of the invention there is a bridged exhaust port with bridge coolant passage means providing a coolant passage of varying elevation through the bridge that is open at its upper and lower ends to the axially extending upper and lower rotor housing coolant passages on opposite sides of the rib containing the exhaust port whereby coolant is heated while in the bridge and rises and thus effects coolant flow through the bridge. Furthermore, it has been shown that the circulation can also be effected or enforced with simple modifications that produce a velocity differential, a ram effect and a negative pressure zone that each taken along or in any combination force flow in the same direction as the heating effect. However, it will also be understood that any one of flow inducing effects thus provided can be used alone where the circulation provided by such action will adequately meet the particular requirements. In addition, it has been demonstrated that the coolant cooled bridged exhaust port can be cast or fabricated and in a very simple manner to provide the desired results.

The above described embodiments are illustrative of the invention which may be modified within the scope of the appended claims.

We claim:

1. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at substantially different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage of varying elevation through said bridge that is open at its opposite ends at substantially different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation.

2. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage of varying elevation through said bridge that is open at its opposite ends at substantially different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation, the two rotor housing coolant passages connected to said bridge coolant passage having substantially different influences on the coolant flow therethrough so that the coolant flow in the connected rotor housing coolant passage at the lower elevation is substantially lesser than that in the connected rotor housing coolant passage at the higher elevation to provide a velocity differential therebetween that is effective to force coolant upward through said bridge coolant passage.

3. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage through said bridge that is open at its opposite ends to said two rotor housing coolant passages, the two rotor housing coolant passages connected to said bridge coolant passage having substantially different influences on the coolant flow therethrough so that the coolant flow in one of the connected rotor housing coolant passages is substantially lesser than that in the other connected rotor housing coolant passage to provide a velocity differential therebetween that is effective to force coolant through said bridge coolant passage.

4. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at substantially different elevations on opposite sides of said one rib, an exhaust port extending through said one rib and said walls, said inner peripheral wall having a peripherally extending coextensive bridge spanning the center of said exhaust port at right angles to said apex seals for supporting said apex seals at their center as they slide over said exhaust port, and bridge coolant passage means for providing a peripherally extending bridge coolant passage of varying elevation through said bridge that is open at its opposite ends at substantially different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation.

5. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at substantially different elevations on opposite sides of said one rib, an exhaust port extending through said one rib and said walls, said inner peripheral wall having a peripherally extending coextensive bridge spanning the center of said exhaust port for supporting said apex seals at their center as they slide over said exhaust port, and a peripherally extending bridge coolant passage of varying elevation through said bridge that is open at its opposite ends at substantially different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation, said bridge coolant passage formed by a hole extending through said outer peripheral wall and said bridge, a plug closing the hole in said outer peripheral wall.

6. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port at an acute angle to said apex seals for supporting said apex seals between their ends as they slide over said exhaust port, and a peripherally extending bridge coolant passage of varying elevation through said bridge that is open at its opposite ends at different elevations to said two rotor housing coolant passage whereby coolant is heated while in said bridge coolant passage and rises to effect coolant flow therethrough from the connected rotor housing coolant passage at the lower elevation to the connected rotor housing coolant passage at the higher elevation, said bridge coolant passage formed by a hole drilled through said bridge from one side of said rotor housing without drilling through any of said walls.

7. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage of varying elevation through said bridge that is open at its opposite ends at different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation, said bridge coolant passage means including a projection at the lower end and on the downstream side of said bridge coolant passage projecting into the connected rotor housing coolant passage at the lower elevation for directing coolant upward into said bridge coolant passage.

8. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage of varying elevation through said bridge that is open at its opposite ends at different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation, said bridge coolant passage means including a projection at the lower end and on the downstream side of said bridge coolant passage projecting into the connected rotor housing coolant passage at the lower elevation for directing coolant upward into said bridge coolant passage, said bridge coolant passage means further including a projection at the upper end and on the upstream side of said bridge coolant passage projecting into the connected rotor housing coolant passage at the higher elevation for creating a reduced pressure zone that induces upward coolant flow through said bridge coolant passage.

9. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage of varying elevation through said bridge that is open at its opposite ends at different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation, said bridge coolant passage means comprising an insert mounted in a slot in said rotor housing extending through said walls and opening to said two rotor housing coolant passages on opposite sides of said one rib, said insert having an inner end providing said bridge and having a hole therethrough providing said bridge coolant passage.

10. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means having a bridge coolant passage of varying elevation cored in said bridge that is open at its opposite ends at different elevations to said two rotor housing coolant passages and has a core opening in said outer peripheral wall, and a closure member closing said core opening whereby coolant is heated while in said bridge coolant passage and rises to effect coolant flow therethrough from the connected rotor housing coolant passage at the lower elevation to the connected rotor housing coolant passage at the higher elevation.

11. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage of varying elevation through said bridge that is open at its opposite ends at different elevations to said two rotor housing coolant passages whereby coolant is heated while in said bridge coolant passage and rises to effect coolant flow therethrough from the connected rotor housing coolant passage at the lower elevation to the connected rotor housing coolant passage at the higher elevation, the two rotor housing coolant passages connected to said bridge coolant passage being constructed so that the coolant flow in the connected rotor housing coolant passage at the lower elevation is substantially greater than that in the connected rotor housing coolant passage at the higher elevation to provide a velocity differential therebetween that is effective to force coolant upward through said bridge coolant passage, said bridge coolant passage means including a projection at the lower end and on the downstream side of said bridge coolant passage projecting into the connected rotor housing coolant passage at the lower elevation for directing coolant upward into said bridge coolant passage.

12. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage through said bridge that is open at its opposite ends to said two rotor housing coolant passages said bridge coolant passage means including a projection at one end and on the downstream side of said bridge coolant passage projecting into the connected rotor housing coolant passage for directing coolant into said bridge coolant passage.

13. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, tow of said rotor housing coolant passages extending on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means for providing a bridge coolant passage through said bridge that is open at its opposite ends to said two rotor housing coolant passages, said bridge coolant passage means including a first projection at one end and on the downstream side of said bridge coolant passage projecting into the connected rotor housing coolant passage for directing coolant into said bridge coolant passage, said bridge coolant passage means further including a second projection at the other end and on the upstream side of said bridge coolant passage projecting into the connected rotor housing coolant passage for creating a reduced pressure zone that induces coolant through said bridge coolant passage in the same direction as said first projection.

14. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means having a bridge coolant passage cored in said bridge that is open at its opposite ends to said two rotor housing coolant passages and has a core opening in said outer peripheral wall, a closure member closing said core opening, said bridge coolant passage means including a first projection at one end and on the downstream side of said bridge coolant passage projecting into the connected rotor housing coolant passage for directing coolant into said bridge coolant passage, said bridge coolant passage means further including a second projection at the other end and on the upstream side of said bridge coolant passage projecting into the connected rotor housing coolant passage for creating a reduced pressure zone that induces coolant flow through said bridge coolant passage in the same direction as said first projection.

15. A rotary combustion engine rotor housing having radially spaced inner and outer peripheral walls joined by a plurality of ribs, a rotor having apex seals that slide on said inner peripheral wall, said walls and ribs defining a plurality of rotor housing coolant passages extending axially through said rotor housing between said walls and on opposite sides of said ribs, one of said ribs having a cross section outline larger than the others, two of said rotor housing coolant passages extending at different elevations on opposite sides of said one rib, an exhaust port extending through said one rib and said walls, said inner peripheral wall having a coextensive bridge spanning said exhaust port for supporting said apex seals between their ends as they slide over said exhaust port, and bridge coolant passage means having a bridge coolant passage of varying elevation cored in said bridge that is open at its opposite ends at different elevations to said two rotor housing coolant passages and has a core opening in said outer peripheral wall, a closure member closing said core opening whereby coolant is heated while in said bridge coolant passage and rises to effect coolant flow therethrough from the connected rotor housing coolant passage at the lower elevation to the connected rotor housing coolant passage at the higher elevation, said bridge coolant passage means including a projection at the lower end and on the downstream side of said bridge coolant passage projecting into the connected rotor housing coolant passage at the lower elevation for directing coolant upward into said bridge coolant passage.

* * * * *

UNITED STATES PATENT AND TRADEMARK OFFICE

CERTIFICATE OF CORRECTION

PATENT NO. : 3,954,356

DATED : May 4, 1976

INVENTOR(S) : Frank J. Winchell, Clarence C. Irwin, Jerry R. Mrlik, Roy S. Cataldo It is certified that error appears in the above-identified patent and that said Letters Patent are hereby corrected as shown below:

Column 1, line 43, after "provide" insert -- in --.
Claim 13, line 9, "tow" should be -- two --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*